United States Patent [19]

Holztrager

[11] Patent Number: 4,752,010

[45] Date of Patent: Jun. 21, 1988

[54] DISPLAY WALL ASSEMBLY

[75] Inventor: William J. Holztrager, Tucker, Ga.

[73] Assignee: Display Systems, Inc., Chilhowie, Va.

[21] Appl. No.: 60,551

[22] Filed: Jun. 11, 1987

[51] Int. Cl.[4] ..... A47F 5/08

[52] U.S. Cl. ..... 211/90

[58] Field of Search ..... 211/90, 87, 187, 189; 248/250, 205.3; 108/108, 152, 149

[56] References Cited

U.S. PATENT DOCUMENTS

| | | | |
|---|---|---|---|
| 3,295,474 | 1/1967 | Ornstein | 248/205.3 |
| 3,918,668 | 11/1975 | Thorpe | 248/205.3 |
| 4,429,850 | 2/1984 | Weber et al. | 108/108 X |
| 4,508,231 | 4/1985 | Honickman | 211/189 X |
| 4,598,504 | 7/1986 | Itagaki | 211/87 X |
| 4,691,887 | 9/1987 | Bessinger | 248/250 |
| 4,694,965 | 9/1987 | Parnell | 211/189 X |

*Primary Examiner*—Robert W. Gibson, Jr.

*Attorney, Agent, or Firm*—Shlesinger, Arkwright & Garvey

[57] ABSTRACT

A display wall assembly including a slatwall panel which comprises the baseboard to which a plurality of elongated profiles are affixed in spaced, parallel relationship, thereby forming a horizontal groove therebetween, a shelf inserted into the horizontal groove, and provided with friction means interposed between the shelf and a portion of the profile to effect the bonding engagement of the shelf with the profile. Stop means engaged with the shelf move into abutting engagement with the slatwall profile to prevent accidental disengagement of the shelf from the slatwall panel.

10 Claims, 1 Drawing Sheet

FIG 1
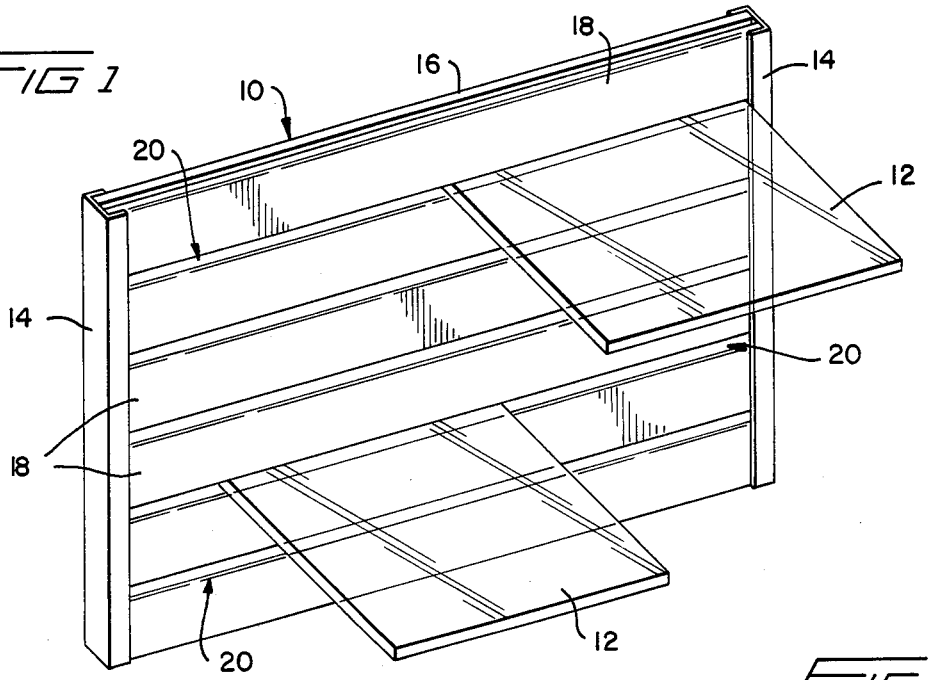
FIG 2
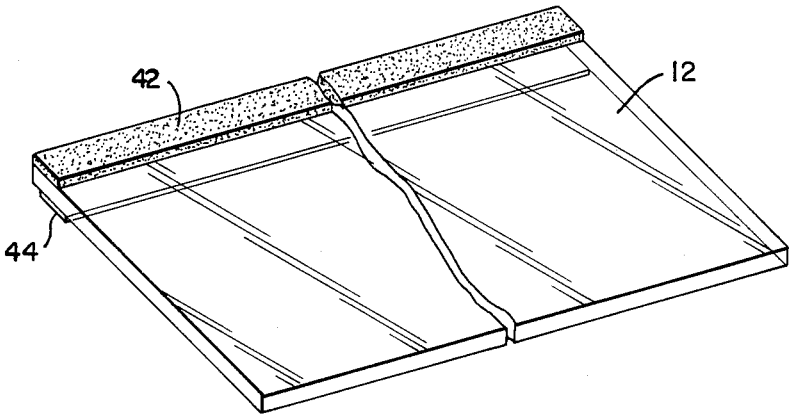
FIG 3
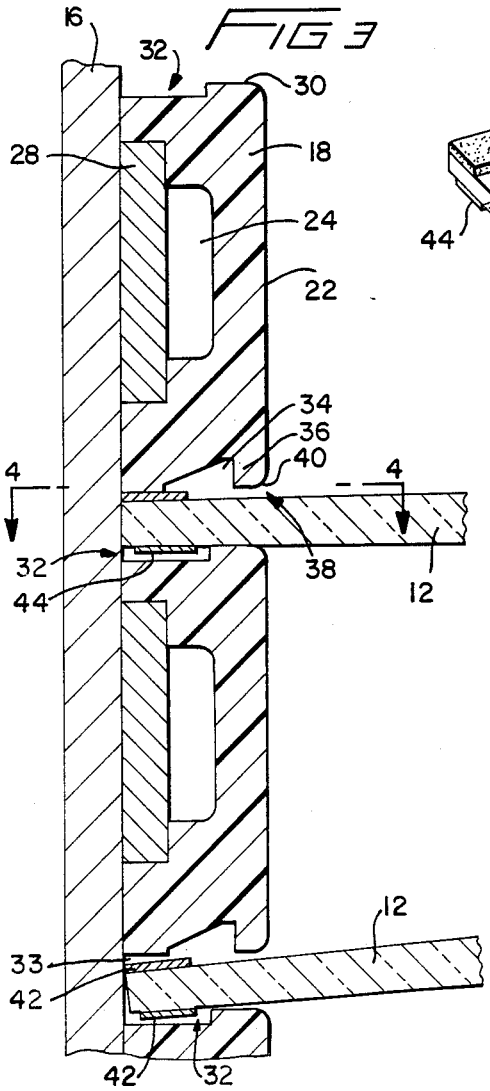
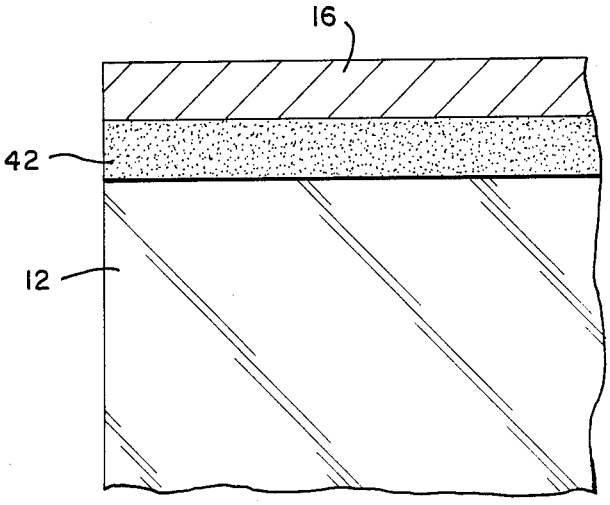
FIG 4

DISPLAY WALL ASSEMBLY

This invention is a display wall panel assembly for use in displaying merchandise in retail stores or the like.

BACKGROUND OF THE INVENTION

It has been standard practice to display merchandise in stores by means of so-called slatwall or slotwall panels by providing profiles or support members which are mounted on a baseboard in spaced, parallel relationship, thereby forming horizontal grooves between adjacent profiles. The horizontal grooves are adapted to receive a shelf or other supporting member on which merchandise is placed for display. Conventionally, the shelf is braced from underneath with wood or metal brackets. In some instances, glass shelves are used in combination with metal knife brackets and standards for support. With this structure, however, only a lip on the front end of the knife bracket holds the glass in place and prevents the shelf from being accidentally dislodged from the supporting brackets. There is no provision for holding the shelf in place if it is hit from either side thereof.

Various other slatwall means have been devised for supporting shelves or the like by making the slatwall of different shapes, and using complemental shelf supporting means, as illustrated in U.S. Pat. No. 4,572,381 issued Feb. 25, 1986 to Fred B. Breakey et al; U.S. Pat. No. 4,591,058 issued May 27, 1986 to Douglas D. Amstutz et al, and U.S. Pat. No. 4,211,379 issued July 8, 1980 to Myron B. Morgan et al. However, all of these devices require specially constructed panels and merchandise supporting members for constructing the assembly.

It is an object of this invention to provide a display wall assembly for merchandise wherein a conventional shelf may be employed as the supporting member, and inserted into the horizontal groove formed by the slatwall, the shelf being held in place within the horizontal groove by securing means, without the necessity of providing exterior brackets.

Another object is to provide a display wall assembly as described, wherein means are provided for preventing accidental movement of the shelf in any direction with respect to the panel, while at the same time permitting the shelf to be readily inserted and removed from the panel groove as desired.

A further object is to provide a display wall assembly wherein the wall panel additionally permits the use of standard slatwall or slotwall hardware which is commonly used in retail merchandising.

SUMMARY OF THE INVENTION

The display wall assembly of the present invention comprises a panel including spaced, substantially parallel profiles or support members which are of generally rectangular cross section, wherein the upper front portion of each of which is raised to provide a shelf support on which a shelf rests which is inserted into the horizontal groove between adjacent profiles. The rear lower portion of the profile is provided with a flat longitudinally extending bearing surface which is engaged by a friction bonding or securing member which is adhered to the longitudinal upper edge of the shelf to securely hold the shelf within the groove during use.

The inner end of the upper top edge of the profile is provided with a longitudinal groove adapted to receive stop means adhesively secured to the underface of the shelf to prevent the shelf from being accidentally pulled out of the horizontal groove during use.

The lower front end of the profile is spaced from the shelf in order to premit the shelf to be angularly inserted into, and removed from, the horizontal groove in order to allow proper bonding engagement of the friction securing member with the profle, and to permit the friction securing member to be disengaged from the profile when it is desired to remove the shelf from the horizontal groove of the panel.

DESCRIPTION OF FIGURES OF THE DRAWING

FIG. 1 is a perspective view of the display wall assembly of the present invention;

FIG. 2 is a perspective view of a shelf forming a part of the present invention;

FIG. 3 is a vertical sectional view of the assembly of the present invention, and FIG. 4 is a sectional view taken along the line 4—4 of FIG. 3, looking in the direction of the arrows.

DETAILED DESCRIPTION OF THE INVENTION

The display wall assembly of the present invention generally includes a slatwall panel 10 having one or more shelves 12 inserted therein for displaying merchandise, and caps 14 may be selectively engaged with the lateral edges of panel 10.

Slatwall panel 10 includes a baseboard 16 which may be made of acrylic, fiberboard, particle board, plywood, metal or wood. A plurality of profiles or support members 18 of like construction are mounted on baseboard 16 by screws and adhesives, such as Borden Chemical Company Casco Bond SC-5435 in parallel, spaced relationship, thereby providing a horizontal groove of uniform width throughout its length, which is adapted to receive shelf 12.

Each profile has a detailed configuration and may be constructed of Ceauaku polyvinylchloride, fiberboard, metal, particle board, polyvinylchloride or wood. In the drawing, there is illustrated a profile which is extruded of polyvinylchloride, which profile is of generally rectangular cross section. Profile 18 includes an outerface 22 which may be finished in any suitable color. In order to reduce manufacturing costs, profile 18 is provided with a central longitudinal groove 24 and a larger inner longitudinal groove 26 in which is inserted a plywood filler 28 for increasing the strength of the profile for supporting the shelf.

The upper edge of each profile 18 is provided with an upstanding flat portion 30 which is substantially coextensive with the length of profile 18, and which serves as a support on which shelf 12 rests. Rearwardly of raised portion 30 is a longitudinal groove 32 which is substantially coextensive with the length of profile 18, for purposes which will be hereinafter more fully set out. The lower portion of profile 18 is provided with a flat longitudinal bearing surface 33 which is substantially coextensive with the length of profile 18, in advance of which is a longitudinal groove 34 of generally triangular shape and cross section for the attachment of slatwall or slotwall hardware. The lower front edge of profile 18 is indicated at 36, the lower limit of which is slightly above the plane of bearing surface 33, thereby providing a space 38 between lower edge 36 and shelf 12, the outer end of the lower edge 36 is beveled at 40.

Shelf 12 is of flat, uniplanar construction, and is made of acrylic, fiberboard, glass, metal or particle board material, the thickness of which is slightly less than the size of horizontal groove 20. In the drawings, there is illustrated a shelf of tempered glass construction ¾" thick which is inserted into a ½" horizontal groove.

In accordance with the object of the present invention, shelf 12 is provided with means for securing the shelf to profile 18 to prevent any accidental disengagement of the shelf from the panel during use. This securing means comprises tape 42 in the form of friction tape such as manufactured by Minnesota Mining and Manufacturing Company under the trademark BUMPON which is adhesively secured to the inner longitudinal edge of the upper face of shelf 12, and is substantially coextensive therewith.

As shown to advantage in FIG. 3, friction tape 42 is adapted to engage bearing surface 3—3 of profile 18, when the shelf is in position, to positively preclude any relative movement between the shelf and the profile while the wall assembly is in use. Weight on the shelf forces the shelf to pivot on support 30, the outer edge of the shelf being deflected downwardly and the inner edge of the shelf being deflected upwardly. The more downward pressure which is exerted on the shelf by the merchandise placed thereon, the tighter is the bond between the shelf and profile 18.

As shown to advantage in FIGS. 2 and 3, shelf 12 is provided with a second strip of tape or the like 44 which is adhesively secured to the underside of shelf 12, which is near, but spaced from, the longitudinal edge of the shelf. Tape 44 may be of the same type as tape 42, and may be continuous in length, as shown in FIG. 2, or may consist or a series of spaced pieces. As shown in FIG. 3, when shelf 12 is in position within groove 20, tape 44 lies within longitudinal groove 32, and serves as a stop to prevent shelf 12 from being pulled straight out of horizontal groove 20, by engaging the upstanding flat portion 30 of profile 18, which lies at the upper front portion of the profile.

In use of the display wall assembly of the present invention, shelf 12 is readily inserted into horizontal groove 20 by holding panel 12 at an angle to the panel, as illustrated in the lower portion of FIG. 3. By virtue of the additional spacing 38, the shelf may be inserted through horizontal groove 20 at the leading edge of profile 18 and, when the inner end of the shelf is adjacent baseboard 16, the shelf may be lowered into a horizontal position so that tape 42 is in bonding engagement with bearing surface 33 of profile 18, and tape 44 lies within longitudinal groove 32 of profile 18.

Merchandise may then be placed on that portion of shelf 12 which lies outwardly of slatwall panel 12, the weight of the merchandise affecting a corresponding upward movement of the inner end of shelf 12 about support 30 and increased bonding of the shelf to the profile.

When it is desired to remove shelf 12 from slatwall panel 10, an upward force is exerted on the outer portion of the shelf to break the bond between tape 42 and bearing surface 33, after which the shelf is withdrawn at an angle from groove 20, as shown in the lower portion of FIG. 3.

The display wall assembly of the present invention provides simple, but efficient, means for displaying merchandise on shelves supported by slatwall panels, without the use of exterior supporting brackets, and without the use of complex and expensive components for holding the merchandise. In the event that it is desired to employ a supporting shelf of reduced thickness, the same slatwall panel can be employed, and friction tape or other bonding means of greater thickness may be applied to the inner end of the shelf to compensate for the reduced thickness of the shelf.

While there has been herein shown and described the presently preferred form of this invention, it is to be understood that such has been done for purposes of illustration only, and that various changes may be made therein within the scope of the appended claims.

What is claimed is:

1. A display wall assembly including (a) a slatwall panel having a baseboard and a plurality of elongated support members affixed to said baseboard, and extending outwardly and longitudinally thereof in spaced, substantially parallel relationship, forming a horizontal groove therebetween;

(b) a shelf inserted into the horizontal groove between said support members, and (c) means within the horizontal groove and interposed between said shelf and one of said support members for removably bonding said shelf to said one of said support members.

2. The display wall assembly of claim 1, wherein (a) each of said support members is of generally rectangular cross section, the front top part thereof having a raised portion which is substantially coextensive with the length of said support member, to provide a shelf support on which said shelf rests.

3. The display wall assembly of claim 2, wherein (a) the rear lower portion of said support member is flattened to provide a longitudinal bearing surface which is substantially coextensive with the length of said support member whereby, upon placement of weight on that portion of said shelf extending outwardly from the horizontal groove, said shelf fulcrums on said shelf support, causing the outer portion of said shelf to be deflected downwardly and the inner portion thereof to be deflected upwardly, to effect tight engagement of said means with said shelf and bearing surface to prevent accidental disengagement of said shelf and support member.

4. The display wall member of claim 3, wherein (a) the rear top part of each of said support members has a longitudinal groove substantially coextensive with the length of said support member, and (b) stop means affixed to the rear bottom face of said shelf and lying within the longitudinal groove of the rear top part of one of said support members, said stop means engaging the raised portion of said front top portion of one of said support members to prevent said shelf from being pulled straight out of the horizontal groove.

5. The display wall assembly of claim 4, wherein (a) said stop means comprises tape adhesively secured to said shelf.

6. The display wall assembly of claim 4, wherein (a) the lower front portion of each of said support members is recessed to provide a space between said lower front portion and the adjacent shelf support of an adjacent support member which is substantially greater than the thickness of said shelf, whereby said shelf may be inserted at a downwardly directed angle into the horizontal groove, and may be removed therefrom by lifting upwardly on the outer portion of said shelf and then removing the angularly disposed shelf from the horizontal groove.

7. The display wall of claim 1, wherein (a) said means comprises friction material for preventing accidental relative movement of said shelf with respect to said support members.

8. The display wall of claim 7, wherein (a) said friction material comprises tape secured longitudinally of the inner upper edge of said shelf, the upper surface of said tape being in sealing engagement with one of said support members.

9. A display wall assembly, including (a) a slatwall panel having a baseboard and a plurality of elongated profiles affixed to said baseboard in spaced, substantially parallel relationship, thereby forming a horizontal groove between said profiles;

(b) a shelf inserted into the horizontal groove formed between said profiles;

(c) each of said profiles being of generally rectangular cross section, the front top part thereof having a raised portion which is substantially coextensive with the length of said profile to provide a shelf support on which said shelf rests;

(d) the rear lower portion of said profile is flattened to provide a longitudinal bearing surface which is substantially coextensive with the length of said profile, and (e) friction tape adhesively secured to the upper surface of said shelf along the inner longitudinal edge thereof;

(f) said friction tape being urged into bonding engagement with said longitudinal bearing surface of said profile upon application of a downward force on the outer portion of said shelf.

10. The display wall assembly of claim 9, wherein (a) the rear top part of each of said profiles has a longitudinal groove substantially coextensive with the length of said profile, and (b) tape affixed to the rear bottom face of said shelf and lying within the longitudinal groove of the rear top part of said profile, when the shelf is inserted into the horizontal groove of the slatwall panel;

(c) said tape engaging the raised portion of said profile to prevent said shelf from being pulled straight out of the horizontal groove.

* * * * *